United States Patent [19]

Williams

[11] Patent Number: 4,628,820

[45] Date of Patent: Dec. 16, 1986

[54] EXTENDED RANGE MINE

[76] Inventor: Theodore M. Williams, 1360 Keneki Pl., Hilo, Hi. 96720

[21] Appl. No.: 750,497

[22] Filed: Jul. 1, 1985

[51] Int. Cl.[4] ..... F42B 22/00

[52] U.S. Cl. ..... 102/411; 102/406

[58] Field of Search ..... 102/406, 411

[56] References Cited

U.S. PATENT DOCUMENTS 3,084,627 4/1963 Holm ..... 102/411

4,317,414 3/1982 Grawe et al. ..... 102/406

*Primary Examiner*—Charles T. Jordan

[57] ABSTRACT

A dual bouyancy elongated cylindrical naval mine connected to a similar bouyance elongated appendage, equipped with sensors, for detecting enemy vessels, having a drogue at end opposite to mine connection and suitable in size and weight for coiling appendage into a bundle for convenience in initial deployment. Initial heavy bouyancy causing mine assemble to sink to ocean floor on initial deployment, with sensors and controls capable of sensing the approach of an enemy vessel and causing mine assembly to rise to surface after blowing ballast from appendage tube/hose and mine, enabling the mine with its appendage extended by sea current action to extend to its full length covering a much greater area than a conventional anchored mine. The drogue appendage being capable of being drawn by enemy vessel's propellor suction causing appendage to wrap around propeller shaft drawing mine to it where striking propeller will explode mine at vessel's most critical area.

1 Claim, 8 Drawing Figures

EXTENDED RANGE MINE

BACKGROUND OF THE INVENTION

Description of Prior Art

Earlier anchored mines often weighed as much as 5,000 pounds for an anchored mine with anchor chain or cable and anchor block. This is 1,000 pounds per foot of coverage. At present there is no dual bouyancy mine with an extended appendage containing sensors to detect enemy ships and cause the mine to rise from its ballast anchored position on the ocean floor to become entangled by ship movement across it's path on the surface and being drawn by strong propeller suction, which is exploded by blows from the propeller damaging the critical shaft sea-water seal and bearing. This bearing is sensitive and critical at 5/10,000 of an inch out of alignment. Submarine launched mines are slow to be launched and endanger a large crew. This invention is light weight with it's ½" diameter appendage hose with minaturized sensing devices all together will be effective and weigh only 300 pounds for the mine and its 300 foot appendage. The twisting enemy ship's propeller with its powerful suction will draw the string like appendage to it and wind the appendage around the shaft and makes the mine explode. The flow of air currents on deployment and afterward sea currents keep the appendage fully stretched out from the heavier mine body. Enemy ship's approaching signals cause the anchored mine to blow it's ballast from mine and appendage and rise into the path of enemy shipping. A 300 pound 300 foot appendage mine weighs one pound per foot. A 5 foot anchored mine will very likely weigh with cable and anchor 5,000 pounds or 1,000 per foot.

SUMMARY

One of the principal disadvantages of the conventional mine is that it is dangerous to commercial navigation as they are known to break loose against the surge of a rising sea action, and so forcibly jerking against their heavy sea anchors to break away and become a menace to all navigation. Hardly a nation in the world has been spared these derelict mines washing ashore. They are prohibitively costly, requiring extremely heavy anchors and extra large explosive charges and, in addition, are likely to strike the least vulnerable front end of a ship. Such heavy mines being heavy and bulky are extremely difficult to deploy in enemy territory. It is, therefore, a primary objective of the present invention to design a mine that can be lighter in weight for easier deployment that will more effectively destroy the enemy's submarines and surface ships by destroying the entire propulsion unit of a vessel.

Another objective of the present invention is to provide a mine that will cover a much larger area than the conventional mine. The minimum objective of the present invention is to provide a mine that will destroy enemy shipping one hundred times more effectively than the conventional anchored mine.

A still further objective of the present invention is to provide a mine that will remain securely anchored on the ocean floor by its own weight, out of the turbulence of the surging wave action on the surface of an ocean, and then rise on signal when its sensors detect the presence of an enemy submarine or ship and become entangled in the proleller and draw the mine to the propeller shaft where the contact sets off the explosion.

The idea of using the enemy's powerfull propeller suction and twisting action of the shaft to twist the string like appendage around it and draw a small but powerful explosive to a most critical area will enable much wider mine coverage. Laying solidly on the ocean floor with it's appendage fully extended by ocean currents aginst the drogue enables this invention to cover a much wider area, while being almost impossible to usual detection means as the appendage does not register on sonar.

The invention with its appendage wrapped neatly around the mine and it's drogue slightly extended is expected to not exceed 300 pounds in weight with a 300 foot appendage. On initial launch with ballast in the mine ballast tank and appendage flotation tube with a sensing message cable and sensors located along the appendage is designed to detect the presence of an enemy vessel and rise in it's path. Due to it's extended coverage with appendage it is more likely to be hit by a ship than an anchored mine with no appendage. The invention is able to rise into the path of an enemy vessel by the blowing of it's ballast out of the appendage tube and mine ballast tank, at which time the mine timer is activated which controls the ability of the mine's explosive charge and arms the mine enabling it to explode on contact with the ship's propeller.

This mine can be manufactured at relatively low cost, as many of its component parts are already stock items in industry.

Various other objectives and advantages of the invention will hereinafter become more fully apparent from the following description of the drawings, illustrating the presently preferred embodiment thereof and wherein.

DESCRIPTION OF THE PREFERRED EMBODIMENT

Figure 1:
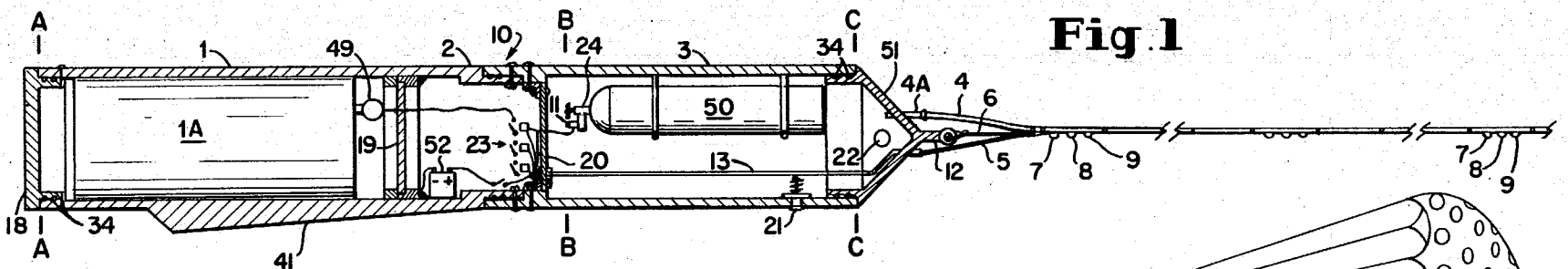
FIG. 1 is a partial side elevational view of the Extended Range Mine with its appendage.
Figure 2:
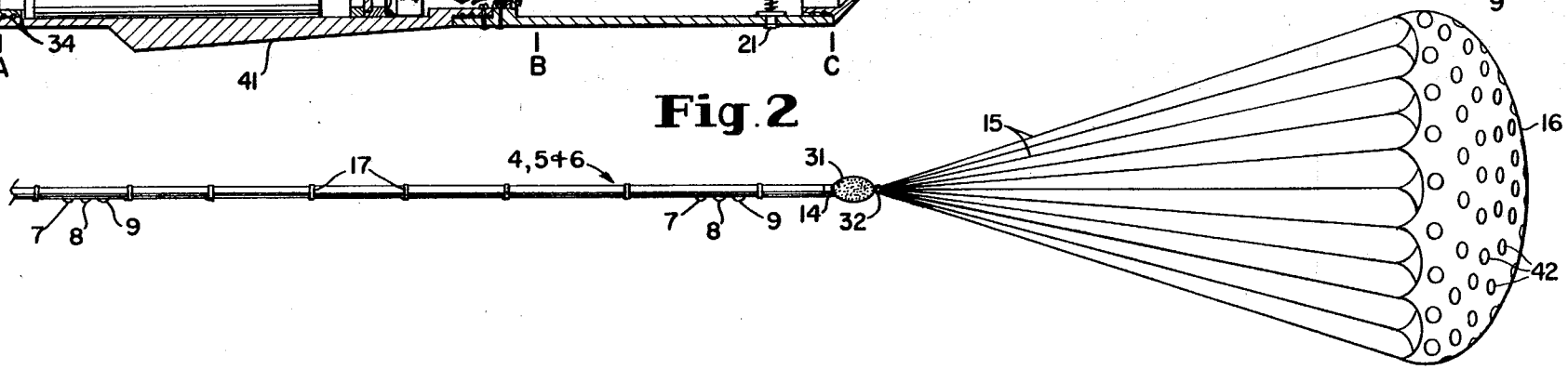
FIG. 2 is a partial side elevational view of the Extended Range Mine and appendage with detail of parachute.

Referring more specifically to the drawings: the Extended Range Mine in its entirity and comprising the envention generally is best seen in FIGS. 1 and 2. These figures illustrate a cylindrical mine with a cone-type front end, attached to an elongated (500 feet or more) hose appendage attached to a parachute/drogue on the opposite end. Item 1 refers to that portion of the mine casing that contains the explosive charge Item 1A. Item 2 is the portion of the mine casing that houses the control panel. Item 3 is the ballast section. It also contains a high-pressure gas cylinder 50 that, with a proper signal of the solonoid valve 11, blows the ballast tank thru a measured orifice that prevents over-pressurization of the ballast tank. The gas pressure in the ballast tank also feeds gas pressure out of the hose ballast assembly and excess gas can escape thru the relief ballast valve 21. Item 4 is the hollow hose that connects at point 4-A in FIG. 4 and runs to the discharge and check valve 14. When this hose is filled with anti-freeze it sinks the hose and cable bundle and when it is blown clear it floats, causing the cables 5 and 6 to rise with it. Item 5 is the control cable assembly which carries signals from the multi-group sensors through separate circuits to the control 23. Mounted along the 500 foot control cable assembly are sensors installed sufficiently close together to prevent the passage of a submarine or surface vessel without the sensors picking up the signal, either acoustically or magnetically. When such signals are received the pressure differential will close a series-wired circuit and send a positive charge of electricity from battery 52 to open the solonoid 11 on the high pressure tank 50 and also arms the explosive device 1-A in the explosive compartment 1. The Extended Range Mine which has been resting firmly on the ocean floor, along with its appendage, will rise as the ballast is blown out of the hose assembly 4, 5 and 6 becoming entangled in the vessel's propeller, thus drawing the mine to the vessel's most critical portion of its structure, namely, its propeller and shaft. Item 6 is a corrosion-resistant steel cable that has sufficient strength to pull the mine thru the water when the cable and/or parachute/drogue is entangeled in a ships propeller and, being flexible, will wrap itself around the moving propeller shaft drawing the mine closer to the vessel with every revolution of the shaft. It connects to the mine at point 12 and the parachute at point 32 on FIG. 5.

The cable shall have the capability to pull the coiled flexible hose assembly and cable out of a deploying aircraft or fast-moving small boat when the parachute is opened in the air stream.

Figure 3:
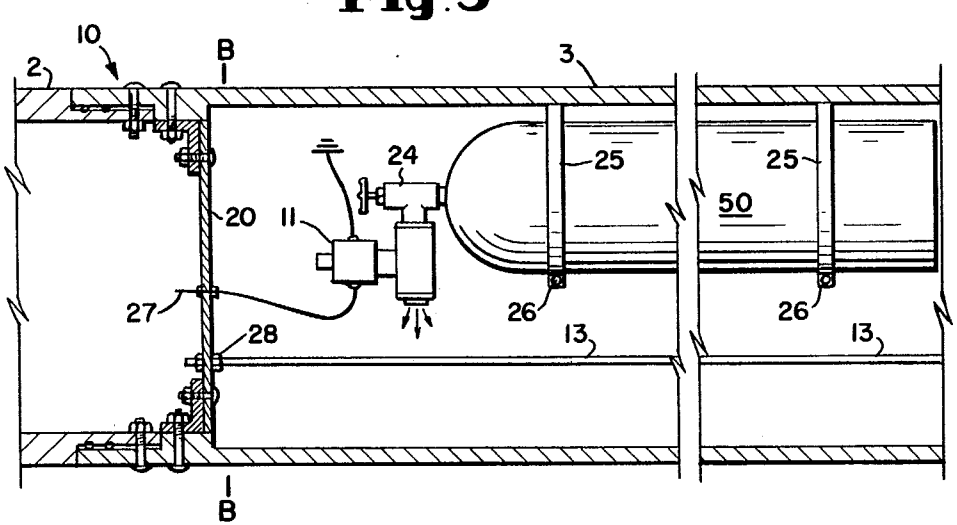
FIG. 3 is a side elevational view of the ballast section 3.

With the hose/cable assembly extended full length the mine can then be automatically dropped in the same operation from the deploying vehicle. Item 7 is a miniaturized magnetic sensor designed to operate in a marine underwater environment and able to resist pressure and temperature differences found in ocean water. It will be able to detect the presence of a ship entering its area and send a signal through the control cable to the control panel 23 in the mine. Item 8 is a miniatureized acoustical sensor designed to operate in a marine environment under water and under water pressure. It shall be able to detect the presence of a vessel as it enters its area and send a signal to the control panel 23 in the mine. Item 9 is a miniaturized pressure differential sensor designed to operate in a marine environment under water. It shall be able to resist the corrosive action of ocean water and not be affected by varying temperature extremes. It shall be capable of sensing the presence of a ship as it enters its area and send a signal through the cable 5 to the control panel 23. Item 10 is the connection point between the control section 2 and the ballast section 3. FIG. 3 B—B best illustrates this connection. Item 11 is the solonoid valve that connects on to the valve 24 on the high-pressure gas tank 50. This is best seen in FIG. 3. Item 12 is the shaft connection to the forward cone-end 51 which is the connecting point for the steel cable 6 as seen in FIG. 1. Item 13 is the conduit that carries the control cable 5 thru the ballast compartment 3. Item 14 is the check valve diffuser assembly that permits the anti-freeze to flow out of the mine ballast and hose 4. (See FIG. 5). Item 15 connects Ring 32 to parachute/-drogue 16. Item 16. Item 16 is the parachute/drogue with numerous holes in it. Its purpose is not to let the mine or hose assembly into the water gently, but rather to pull out the hose/cable assembly from the deploying craft so that the mine attached to the opposite end can be dropped similarly to the way a torpedo is launched into the water i.e. horizontally. Item 17 is the fastening devices used to fasten the appendage cable 5 and 6 and the ballast hose 4 into a signle assembly. The fastening fiberglass tape should be placed at intervals of 8 or 10 inches, as needed, and then coated with a liquid rubber-like marine resistant coating that will last well in a harsh underwater environment. Item 19 is the tightly sealed bulkhead between the explosive compartment 1 and the control compartment 2. It can be welded gas tight into place, or any suitable state of the art thechnology may be used. Item 20 is the bulkhead between the control compartment 2 and the ballast section 3. It shall be removable to permit access to the portion of the ballast compartment as needed. It is best illustrated in FIG. 3, Section B—B. Item 21 is the ballast pressure discharge valve. (See FIG. 7). It is noted here that the outside force of the ocean pressure against the outside of the valve at great depths is considerable, and that the inside pressure of the tank ballast will be set with the spring tension for a minimum of 100 pounds (P.S.I.) over the outside pressure on the outer valve surface. On electric signal the high pressure gas in the tank 50 is released through the solonoid 11 and pressurizes the ballast section, assuring that the pressure in the tank never exceeds 100 P.S.I., or best optimal pressure, thus assuring a satisfactory discharge to the ballast hose assembly 4. Item 22 is the filler cap and filler opening used to fill the ballast and hose pressure with anti-freeze solution for ballast. (See FIG. 1). Item 23 is the controls in their entirety and the control panel in particular. These controls consist of three different type sensors: magnetic, acoustic, and pressure differential, as described in Items 7, 8 and 9 respectively. They are to be installed in groups of three (one of each group) at intervals along the elongated appendage consisting of Items 4, 5 and 6 respectively, and send an electrical signal through a control circuit back to the series-wired control panel 23 located in compartment 2. The positive signal from all three types of sensors causes the series-wired circuits to close their relays and send the series-wired positive electric power to flow to the ballast solonoid 11 and to the explosion timer 49, causing the Extended Range Mine to rise and become entangled in the enemy's vessel propeller and destroy the ship. This patent application does not attempt to claim any novelty on any explosive devices located in the explosive compartment of the Extended Range Mine, as naval sources have already developed explosives charges and their controls to a high degree. The Extended Range Mine is a far safer device than the conventional moored anchored mine that pulls and jerks heavily against its mooring in a surging sea. There is hardly a nation in the world that has not had derelict mines wash ashore during wartime and peacetime as well.

Figure 4:
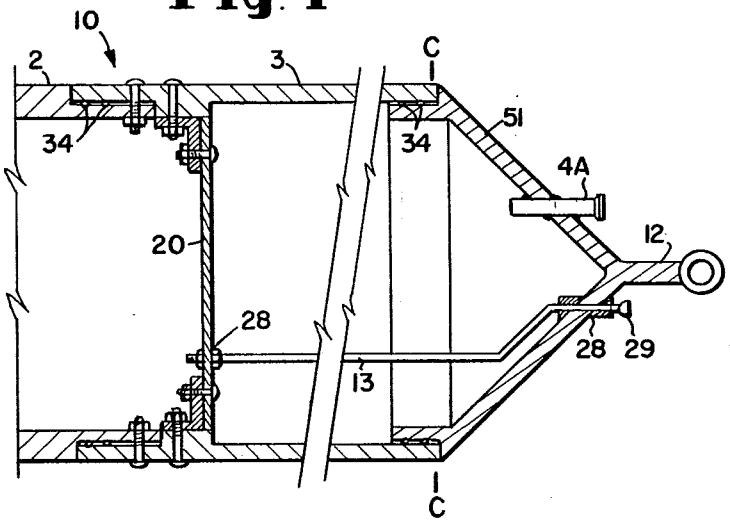
FIG. 4 is a side elevational view of the ballast section conduit 13.
Figure 6:
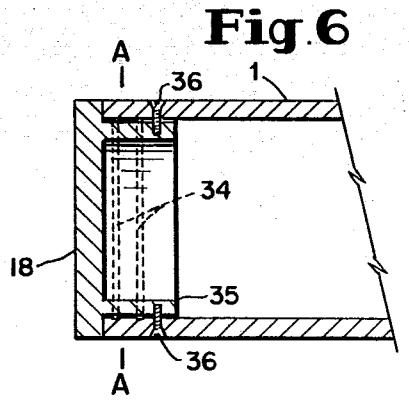
FIG. 6 is a side elevational view of the aft end of the mine 18.
Figure 5:
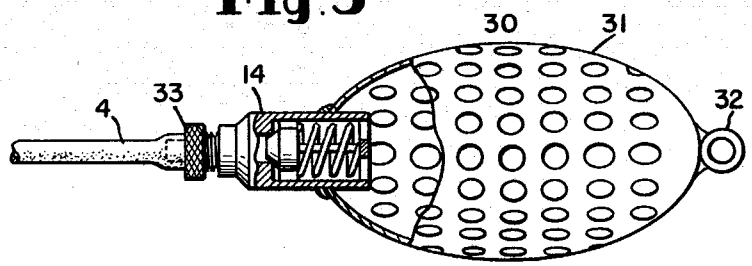
FIG. 5 is a side elevational view of the hose check valve 14.
Figure 8:
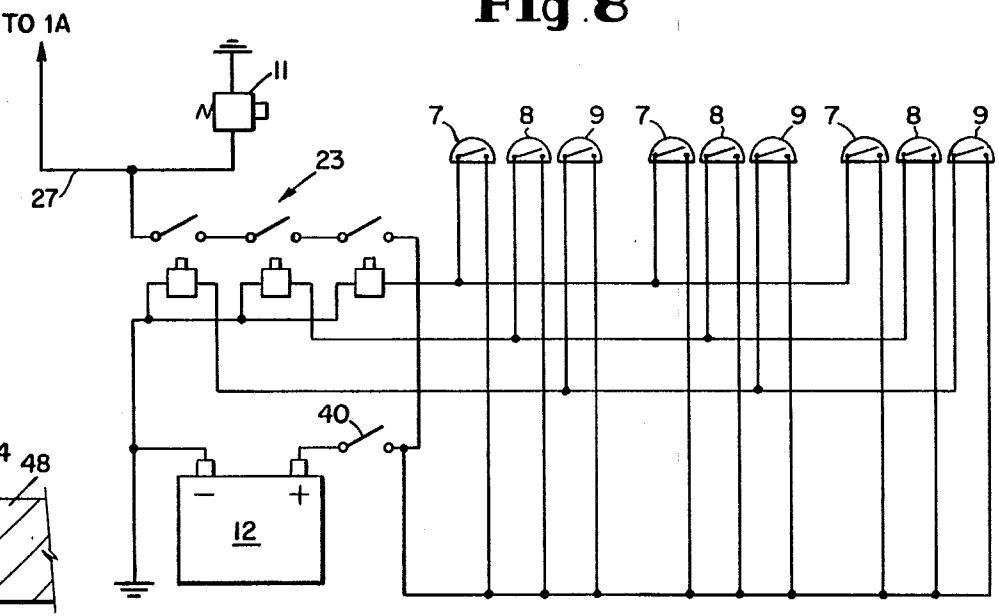
FIG. 8 is a wiring diagram of the control circuit.
Figure 7:
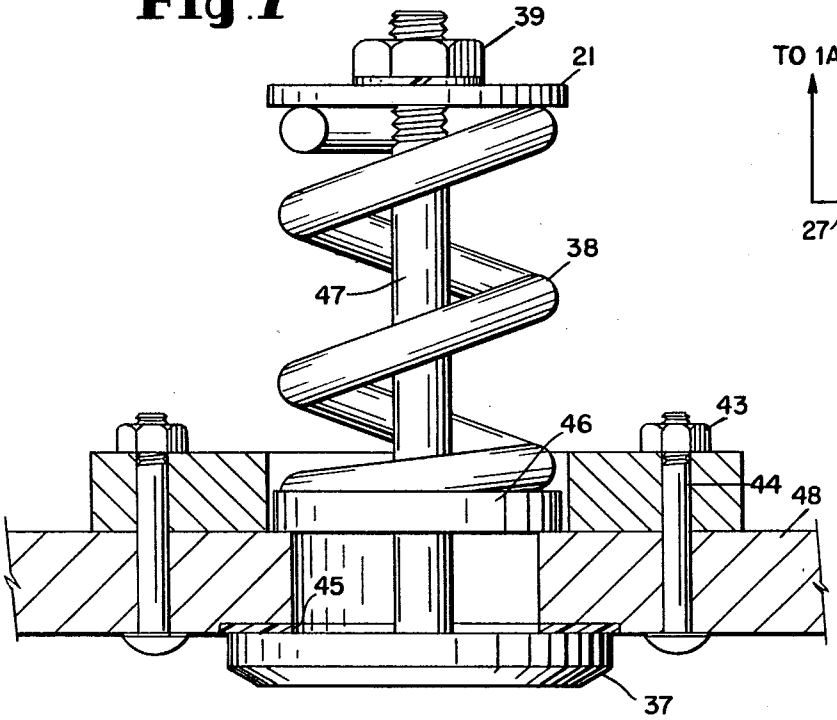
FIG. 7 is a side elevational view of the ballast discharge valve 21.

Item 24 is a hand valve on the high pressure gas tank 50 that contains carbon dioxide or equal gas. Item 25 is the two brackets that secure the gas tank 50 to the bulkhead of the ballast compartment. Item 26 is the fastening bolts and nuts that fasten the tank 50 to the brackets 25. Item 27 is the waterproof control wire that connects between the solonoid valve 11 and control panel 23. Item 28 is the adequately sealed connection where the control cable 5 passes thru the conduit 13 (FIG. 4). Item 29 is a marine packing gland that seals the outlet for cable 5 (FIG. 4). Item 30 is the perforation holes in the diffuser 31 (FIG. 5). Item 31 is the ballast discharge diffuser that prevents whiplash of hose 4 (FIG. 5). Item 32 is the attachment for parachute/drogue 15 (FIG. 5). Item 33 is the connector for hose 4 and diffuser 31 (FIG. 5). Item 34 is dual "O" ring seals used on all closure joints (FIG. 6). Item 35 is a metal flange for closure of explosive compartment 1 on 18 (FIG. 6). Item 36 is a view of machine screw used to secure bulkhead 18 and to be used with a gasket or suitable sealant (FIG. 6). Item 37 is the relief valve outer mushroom valve closure (FIG. 7) gasketed. Item 38 is the adjustable tension spring on valve 21 (FIG. 7). Item 39 is the slip-resistant nut used on valve 21 (FIG. 7). Item 40 is the primary electrical system OFF/ON switch as shown on FIG. 8 that could be activated when the Extended Range Mine is launched. Item 41 is the weighted keel of the body of the Extended Range Mine, which functions to keep ballast discharge valve 21 permanently facing downward. (FIG. 1). Item 42 is hole in parachute/drogue to keep it from floating. This unit is to be only 5 or 6 feet in diameter to easily deploy the hose/cable appendage bundle (FIG. 2). Item 43 is the fastener nut in FIG. 7. Item 44 is a fastener bolt. Item 45 is the gasket seal in FIG. 7. Item 47 is the valve stem in FIG. 7. Item 48 is the cross-section of the outer ballast mine casing that should be constructed of steel of sufficient thickness and should be given an adequate marine coating. Item 50 is the high pressure gas cylinder that will contain carbon dioxide, or other suitable high pressure gas, that will blow the ballast and ballast hose rapidly and causing the mine assembly to become mobile. Item 51 is the nose cone of the mine, best seen in FIG. 4. Item 52 is the dry cell battery designed for long life and with adequate voltage for its use. (FIG. 1).

What I claim is:

1. An extended range mine having an aft closure and a cone shaped front closure; said mine having compartments therein for explosives, electrical equipment, ballast means and mine control means; a flexible appendage connected at one end to said cone shaped front closure and at its opposite end to a drogue chute, said appendage having ballast discharge means adjacent said drogue chute connection, bouyancy means, sensors and electrical conducting means; wherein upon deployment, said mine sinks to the ocean floor where ocean currents cause said drogue chute to extend said appendage to its full length and when sensors detect the presence of an enemy vessel, said mine control means causes said mine to blow ballast from said appendage and mine such that said mine and said appendage floats to the surface where it has the opportunity for said extended appendage to become entangled in a vessel's propulsion unit and thus explode said mine.

* * * * *